United States Patent [19]

Kluczynski

[11] Patent Number: 4,987,927

[45] Date of Patent: Jan. 29, 1991

[54] DIRECT-DRIVE VALVE

[75] Inventor: Mathew L. Kluczynski, Chatsworth, Calif.

[73] Assignee: Sterer Engineering and Manufacturing Company, Los Angeles, Calif.

[21] Appl. No.: 289,740

[22] Filed: Dec. 27, 1988

[51] Int. Cl.[5] ..... F15B 13/044

[52] U.S. Cl. ..... 137/625.65; 137/625.64

[58] Field of Search ..... 137/625.63, 625.64, 137/625.65

[56] References Cited

U.S. PATENT DOCUMENTS

| | | | |
|---|---|---|---|
| 3,114,394 | 12/1963 | Panissida | 137/625.64 |
| 3,455,334 | 7/1969 | Martinson | 137/625.61 |
| 3,756,278 | 9/1973 | Melf | 137/625.63 |
| 3,865,140 | 2/1975 | Greenwood | 137/625.65 X |
| 4,672,992 | 6/1987 | Vanderlaan et al. | 137/625.65 X |
| 4,844,125 | 7/1989 | McKay et al. | 137/625.65 |

FOREIGN PATENT DOCUMENTS

| | | | |
|---|---|---|---|
| 2347560 | 3/1975 | Fed. Rep. of Germany | 137/625.63 |
| 72063 | 3/1960 | France | 137/625.63 |
| 59-17004 | 1/1984 | Japan | 137/625.63 |

*Primary Examiner*—Gerald A. Michalsky
*Attorney, Agent, or Firm*—Baker & McKenzie

[57] ABSTRACT

A direct-drive hydraulic control valve having a valve spool mounted in a spool bore and variably positioned in the bore to control a flow of pressure fluid from a source to a controlled device, shown as a hydraulic cylinder. The valve is driven by a reversible electric D.C. torque motor of the incremental stepper type having an eccentric output shaft that projects into a central opening in the valve spool and is engaged on its opposite sides by elongated drive pins that are movably mounted in longitudinal bores in the opposite end portions of the spool. Each drive pin engages a ball that is seated in the end of the longitudinal bore in a pressure chamber at the end of the spool bore, forming a check valve, and drives the spool through the ball, which normally is held in place by high pressure fluid in the end pressure chamber. If the resistance to movement of the spool rises to exceed the seating force on the ball, the drive pin unseats the ball at the leading end of the spool, venting the pressure chamber at the leading end so that a pressure differential is created across the spool for a hydraulic boost in the driving force on the spool. One alternative drive mechanism uses a lever, pivoted between its ends, connectible to a linear drive motor, instead of the eccentric shaft and stepper motor.

18 Claims, 1 Drawing Sheet

DIRECT-DRIVE VALVE

BACKGROUND OF THE INVENTION

This invention relates to a hydraulic valve for controlling the flow of fluid under pressure from a source to a using or driven device, and relates more particularly to a direct-drive hydraulic valve.

Hydraulic control valves have long been used to control flows of pressure fluid to various kinds of using devices, one field of particular significance being the aerospace industry where such valves control mechanisms of various kinds in an aircraft. Typically, the valve is interposed between the high pressure source and the using device, and has a movable valve member that is selectively positioned in a stationary valve body to establish fluid flow paths through the valve between the source and the device, the effective areas of the flow paths determining the rates of flow through the valve.

A frequently used type of valve has a sleeve that is mounted in a valve body which defines an elongated bore with a plurality of openings or ports spaced longitudinally of the bore, usually in the form of slots in the sleeve, and a valve spool tightly but slidably fitted in the bore to move back and forth therein and having lands and spool ports for overlying and communicating with different combinations of ports in the valve body. For example, the pressure source may be connected to one or more of the ports in the body, and the using device may be connected to one or more of the other ports, and the spool may have lands and ports for establishing a flow path or paths connecting the source to the device. For a reversible device, alternate paths are established for "forward" and "reverse" operation.

In conventional electrohydraulic valves, a portion of the available pressure fluid usually is used to position the spool in the bore, thereby to control the main portion of the flow to the using device. One difficulty with this type of valve, however, is the loss of some of the available energy when the valve is inactive, through so-called "quiescent flow" in the valve past the spool. Moreover, as the pressure levels used in such systems in the aircraft industry have increased in recent years, quiescent losses also have tended to increase.

Another difficulty that sometimes is encounted in hydraulic control valves is obstruction of movement of the spool by a foreign particle which becomes jammed somewhere between the two relatively movable parts, and which presents a resistance to movement that is greater than the maximum driving force that is available to move the spool, sometimes referred to as the "chip-shearing force". To develop relatively high forces, higher pressures and larger driven surface areas can be used, but these tend to increase not only the energy losses in the system but also the size and weight, which are critical factors in the aircraft industry.

An alternative to a hydraulically driven valve member is a direct drive for the spool, such as a linear electrical motor with a linear variable differential transformer providing feedback for positioning of the spool, or a rotary motor, such as a D.C. torque motor, producing rotary motion at an output shaft that is converted to linear motion of the spool.

Such direct-drive valves have the advantage of consuming driving energy only on demand, have no quiescent flow, and have become feasible as a result of recent increases in the electrical power levels available in the aircraft industry. The principle problem with such valves, however, is the limited amount of chip-shearing force that direct-drive valves are capable of developing with even the higher levels of electrical power that now are available. Claims have been made that chip-shearing forces on the order of eighty pounds can be developed, and forces of this magnitude are regarded as marginal. Moreover, the direct-drive valves that presently are proposed are objectionably large, compared to the electrohydraulic valves that have been in use.

Accordingly, the primary objective of the present invention is to provide a significantly improved driving mechanism which overcomes these deficiencies and is acceptable as a replacement for the electrohydraulic valves that presently are in use.

SUMMARY OF THE INVENTION

The present invention resides in a novel direct-drive valve in which the movable valve member normally is positioned by a mechanical driver that is moved by an electric motor capable of applying a limited driving force that is sufficiently high for normal operating conditions, and having means responsive to the encountering of a resistance greater than a preselected limited level to apply to the spool a temporary hydraulic driving force that is substantially greater than the force that can be mechanically applied. In this way, the shortcomings of conventional electrohydraulic valves are avoided while optimum chip-shearing forces still can be achieved, in a size and configuration that may be interchangeable with present electrohydraulic valves.

More specifically, the presently preferred embodiment of the direct-drive valve of the present invention has a valve spool having opposite end portions or sections disposed on opposite sides of a central driver and each loosely and movably mounting a driver pin in a longitudinal bore having a check valve at its outer end. The check valves have movable valve members against which the driver pins abut, tending to unseat the check valve member as the driver pin is moved toward that end of the spool. The driver that engages the pins between the two end portions of the spool is the output member of the drive motor, capable of pushing either of the driver pins away from the center and toward the end of the spool, and at each end of the spool is a pressure chamber into which the high-pressure supply fluid is introduced. Each of the check valves is held closed by a pressure differential across the movable check valve member, designed to be somewhat less than the maximum force that the drive motor is capable of developing.

Thus, the valve spool normally is positioned in the spool bore by the drive motor, acting on the check valves through the driver pins and, through the check valves, on the spool. When an obstruction is encountered, however, the force of the motor output member attempting to overcome the obstruction unseats the check valve member at the leading end of the spool, and vents the pressure chamber at that end, through the longitudinal bore in the spool. This creates a pressure differential across the spool, applying the full force of this pressure differential to the trailing end of the spool and thus developing the maximum available chip-shearing force to overcome the obstruction.

For simplicity of construction, the check valves are formed as ball valves, having balls that are seated in the ends of the longitudinal bores in the spool portions, each ball being mounted on a supporting pin that extends across the adjacent pressure chamber and is slidably received in a slideway in the valve body, so that each ball is movable with the spool under normal operation and into and out of engagement with its seat when chip-shearing. The driver pins have outer end portions of reduced size to provide a flow passage from the end chamber, being substantially smaller in diameter than the balls so that a seating force is developed on each ball by the pressure differential across the ball.

Various driving motors may be used with a valve of this kind, the presently preferred motor being a D.C. torque motor of the reversible, incremental stepper type capable of receiving digital commands (including analog signals converted to digital) and having an eccentric output shaft that is disposed between the inner ends of the driver pins. With such a motor, each electrical pulse that is received as a command turns the output shaft through a preselected increment, and the eccentricity of the shaft is designed to produce the desired amount of longitudinal movement of the valve member with this rotary movement. In an alternative drive that illustrates the principle of the valve, a lever with a pivot between its ends has one end disposed between the driver pins and an opposite end capable of being driven by a reversible linear actuator.

Other aspects and advantages of the invention will become apparent from the following detailed description, taken in conjunction with the accompanying drawings.

DETAILED DESCRIPTION OF THE PREFERRED EMBODIMENT (FIGS. 1 AND 2)

Figure 1:
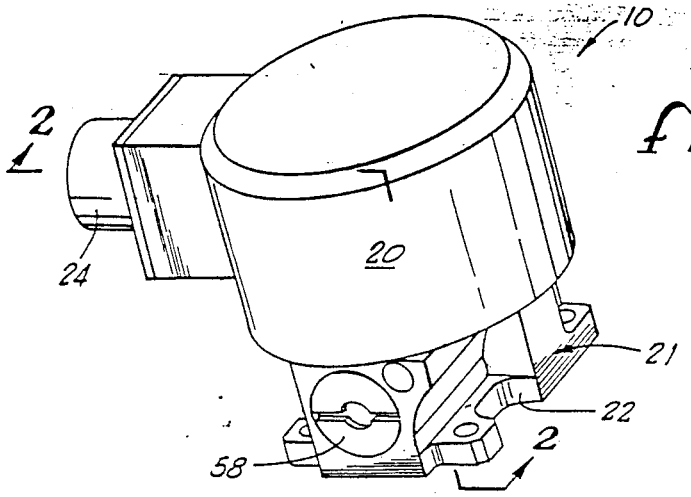
FIG. 1 is an isometric external view of a direct-drive valve embodying the novel features of the present invention.
Figure 2:
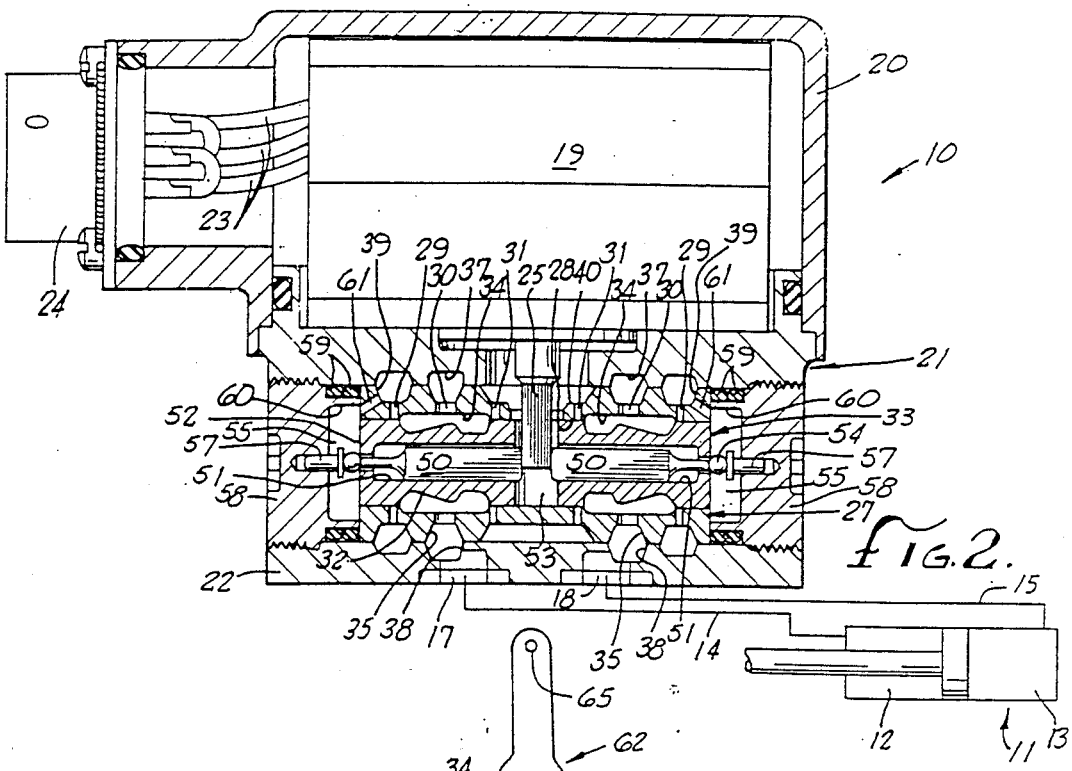
FIG. 2 is a cross-sectional view, on an enlarged scale, taken substantially along line 213 2 of FIG. 1 with a driven hydraulic cylinder shown schematically.

As shown in the drawings for purposes of illustration, the invention is incorporated in a control valve assembly, indicated generally by the reference number 10, for controlling a flow of fluid under pressure from a source (not shown) of high pressure fluid to a using or driven device. For example, the source may be the hydraulic system of an aircraft, and the using or driven device may be a hydraulic cylinder 11, as illustrated schematically in FIG. 2, having opposite ends 12 and 13 connected by two cylinder lines 14 and 15 to the outlets 17 and 18 of the control valve.

In general, the illustrative control valve 10 comprises a reversible electric motor 19 that is enclosed in a cover 20 and mounted on one side of a valve manifold assembly 21, having a base 22 that is adapted to be bolted to a supporting surface (not shown) through which the lines 14 and 15 extend. The motor is energized through electrical wiring 23 and a connector 24 of a conventional configuration, and has a rotary output shaft 25 that projects into the manifold assembly, downwardly as viewed in FIG. 2.

Inside the manifold assembly are the principal elements of the valve 10, in this instance a valve body including a sleeve 27, which is the stationary valve member and defines an elongated spool bore 28 with a plurality of valve ports, herein in two sets, each numbered 29 through 31, spaced apart longitudinally along the bore, and a valve spool 33. The spool is closely but slidably fitted in the bore and formed with two spool ports 32 in its opposite end portions for establishing and varying communication between selected ports in the spool. The valve spool has two substantially identical opposite end portions, with one of the spool ports 32 formed in each of these end portions and comprising a shaped peripheral groove around the spool of substantial axial length and having opposite edges that are slidably engageable with the sleeve at the outside diameter of the spool.

The two sets of sleeve ports 29 through 31 are formed in opposite end portions of the spool bore 28, the central ports 30 being the radially inner ends of an annular series of holes in the sleeve, encircling the spool ports 32 and generally centered thereon so as to remain in communication with the spool ports in different positions of the spool. These holes herein open inwardly into a wide and shallow internal groove 34 in the sleeve, of substantially the same axial extent as the spool ports 32, and communicate at their outer ends with a peripheral groove 35 in the outside surface of the sleeve. These grooves are aligned with similar grooves 37 in the housing 21, connecting with the ports 38 in the base 22, which are connectible to the lines 14 and 15 to the cylinder 11.

On opposite sides of each of the central ports 30, the ports 29 and 31 are formed as the radially inner ends of two annular rows of holes extending into the sleeve from annular external grooves 39 and 40 in the sleeve. In this instance, the grooves 39 that are closest to the ends of the spool bore are connectible to the source of fluid under pressure through passages (not shown) in the valve assembly, so that the ports 29 are the "pressure" ports of the valve. The holes forming the ports 31 closest to the center of the spool open outwardly into a broad central external groove 40, which serves both sets of ports 31 and is connectible through passages (not shown) to a sump of the hydraulic system. Thus, the ports 31 are the "return" ports of the valve.

When one set of the pressure ports 29 is overlapped by the spool port 32 on one end portion of the spool 33, pressure fluid flows from the source to the cylinder ports 38 at that end of the spool bore 28 and thus to one end of the cylinder 11 to drive the latter. At the same time, the return ports 31 at the other end of the bore are overlapped by the spool port 32 at the other end of the spool to receive the exhaust flow from the other end of the cylinder and direct that flow to the return 40. The pressure ports are designed, in a conventional way, to meter fluid flow to the cylinder 11 for controlled movement of the piston in the cylinder.

Positioning of the valve spool 33 in the bore 28 during normal operation is accomplished by direct-drive mechanical drive means including two elongated driver pins 50 that are loosely fitted in two central longitudinal bores 51 in the opposite end portions of the spool, each bore having an outer end portion of reduced diameter that opens through the outer end 52 of the spool and each driver pin 50 having an outer end portion of correspondingly reduced diameter disposed in the outer end portion of the bore. The inner ends of the driver pins extend into the space 53 between the opposite end portions of the spool, and abut against opposite sides of the motor output shaft 25. This internal space in the valve spool communicates with the return ports 31.

At each end 52 of the spool 33 is a check valve including a ball 54 that normally closes the outer end of the longitudinal bore in the spool and acts as a coupling between the driver 50 pin and the spool. The balls 54 are supported in chambers 55 at the ends of the spool for movement into and out of engagement with the seats formed by the reduced-diameter portions of the longitudinal bores, herein on support pins 57 secured to the balls and slidably mounted in blind bores in closure plugs 58 at the ends of the spool bore. These plugs cooperate with the spool ends 52 in defining the chambers 55, and carry seal rings 59 that are fitted around an annular internal flange 60 on each plug to seal the outer end of each chamber against leakage of pressure fluid.

The chambers 55 at the ends of the valve spool are connectible to the source of fluid under pressure herein through orifices 61 forming passages from the "pressure" grooves 39, to apply high pressure fluid to opposite ends 52 of the spool during normal operation. Thus, the ball check valves constitute means responsive to the encountering of resistance to spool movement, in either direction, that is greater than the closing force on the check valves, and operable in response to such resistance to vent the chamber 55 at the leading end of the spool, thereby to apply a significantly greater driving force to the spool by applying a hydraulic pressure differential across the spool This enables the spool to develop substantially greater chip-shearing forces than can be developed by the mechanical direct-drive components, but uses the hydraulic boost only momentarily, upon demand and as required. This avoids the energy losses that result from quiescent flow in conventional hydraulic valves during normal operation.

DETAILED DESCRIPTION OF ALTERNATIVE EMBODIMENT (FIG. 3)

Figure 3:
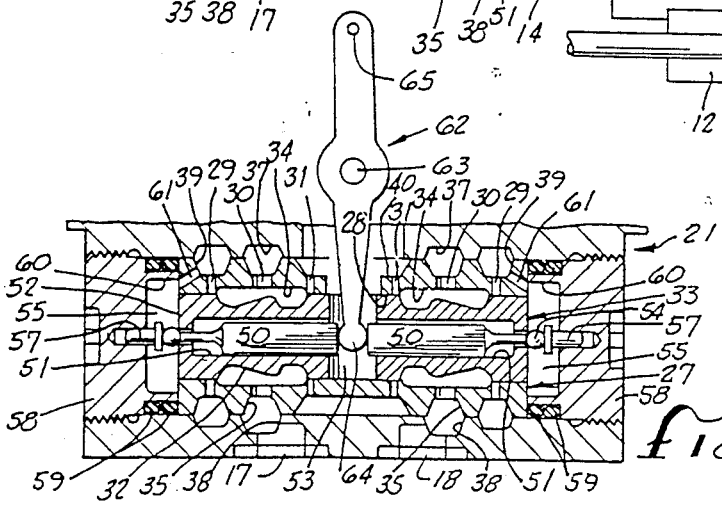
FIG. 3 is a fragmentary cross-sectional view similar to a portion of FIG. 2 and showing an alternative form of the invention.

In the alternative embodiment shown in FIG. 3, the only change is the replacement of the eccentric driver with a drive lever 62, pivoted between its ends on a pin 63 and having one end 64 that is disposed between the drive pins 50 to drive the spool 33, and an opposite end 65 for connection to a linear drive motor (not shown). In other respects, operation of the alternative embodiment is the same as in the first instance.

CONCLUSION

It will be seen that the temporary hydraulic boost that is provided will terminate as soon as the obstruction is overcome and the spool section moves, permitting the ball 54 to re-seat against the spool end 52. Thus the direct-drive valve provides for hydraulic amplification of the driving force, upon demand. It also will be evident that, while two embodiments of the invention have been illustrated and described, various modifications and changes may be made within the spirt and scope of the invention, and in particular, it is to be understood that the invention is adapted for use with any kind of a mechanical driver of relatively low force capability that is not itself capable of developing a required level of chip-shearing force.

I claim as my invention:

1. A direct-drive hydraulic valve for controlling a flow of fluid under pressure from a source to a driven cylinder comprising:

a valve body defining a bore having a plurality of valve ports spaced apart longitudinally of the bore and including two cylinder ports in opposite end portions of the bore, and a pressure port and a return port on opposite sides of each of said cylinder ports, said pressure ports being connectible to the source and said cylinder ports being connectible to opposite ends of the driven cylinder;

a valve spool slidably mounted in said bore and comprising two opposite end portions each overlying one of said cylinder ports, said spool being movable in one direction in said bore to establish and progressively increase communication between one of said cylinder ports and the associated pressure port and between the other cylinder port and the associated return port, and being movable in the opposite direction to establish and progressively increase communication between the other of said cylinder ports and the associated pressure port and between said one cylinder port and the associated return port;

said spool having a central opening between said spool end portions and each of said spool end portions having a longitudinal passage that opens into said central opening and through the end of the spool;

drive means for shifting said spool back and forth in said bore, including:

drive pins movably disposed in said longitudinal passages and each having an inner end disposed in said central opening and an outer end disposed within the longitudinal passage at the end of the spool, a driver projecting into said central opening and engaging said inner ends of said drive pins, said driver being selectively and reversably operable to push one or the other of said pins toward the end of the longitudinal passage in which the pin is disposed, and a check valve at each end of said spool and normally closing the longitudinal passage at that end, each of said check valves including a valve seat at the end of the passage and a ball supported for movement into and out of closing engagement with the valve seat, the outer ends of said pins being engageable with the balls to push the balls and said spool along said bore;

means defining two pressure chambers in said valve body at the opposite ends of said spool and connectible to said source to apply equal hydraulic forces to said opposite ends of the spool, said passages being connectible to relatively low pressure whereby said check valves normally are held closed by a preselected closing force resulting from the pressure differential across the balls and move as parts of said spool;

said driver being movable alternatively toward each end of said valve bore and capable of applying a preselected driving force to said pins, thereby to move the valve spool along the bore and, when a resistance to such movement greater than said closing force is encountered, to unseat the ball at the leading end of the spool to vent the pressure chamber at that end past the unseated ball, thereby to develop a pressure differential across the spool for overcoming the resistance to movement of the spool.

2. A direct-drive valve as defined in claim 1 in which said driver is an eccentric shaft disposed between said pins, with the latter engaging opposite sides of said shaft.

3. A direct-drive valve as defined in claim 2 in which said means for moving said driver is a reversible incremental stepper motor for turning said eccentric shaft to produce linear motion of said pins.

4. A direct-drive valve as defined in claim 1 wherein said driver is a lever having one end disposed between said drive pins and an opposite end for connection to a linear motor.

5. A direct-drive valve as defined in claim 1 wherein said balls are supported in said pressure chambers on guide pins that are connected to said balls and extend across said chambers, said valve body having slideways that movably receive said guide pins and thereby support said balls for movement toward and away from said seats.

6. A direct-drive hydraulic valve for controlling a flow of fluid under pressure from a pressure source to a driven device, said valve comprising:

a valve body defining a spool bore having a plurality of valve ports spaced apart along the bore and two pressure chambers at opposite ends of the bore, said pressure chambers and two of said ports being pressure ports connectible to the source and two of said ports being outlet ports connectible to the driven device;

a valve spool slidably mounted in said bore and having ends disposed in said pressure chambers, said spool having port means therein for establishing and varying communication between said pressure ports and said outlet ports upon movement along said bore;

and reversible drive means for positioning said spool in said bore, including:

a reversible motor having an output member, mechanical drive means on said valve spool engageable by said output member to drive said spool along said bore, and including a coupling member operable in each direction to transmit motion from said output member to said spool, and valve means responsive to resistance to movement of said spool in either direction and operable to vent the pressure chamber at the leading end of said spool in that direction of movement, thereby to apply a fluid pressure differential to said spool to overcome the resistance to movement.

7. A direct-drive hydraulic valve as defined in claim 6 wherein said mechanical drive means comprise drive members movably mounted in said spool and abutting against said coupling members to drive said spool.

8. A direct-drive hydraulic valve as defined in claim 7 wherein said drive members are elongated drive pins slidably mounted in longitudinal bores in said spool, and said coupling members are positioned at the opposite ends of said bores.

9. A direct-drive hydraulic valve as defined in claim 8 wherein said output member is a rotary eccentric shaft projecting into said spool and disposed between said drive pins.

10. A direct-drive hydraulic valve as defined in claim 8 wherein said coupling members are check valves at the opposite ends of said longitudinal bores, normally held closed by the pressure differential produced by pressure fluid in the pressure chamber and being opened in response to said resistance to movement.

11. A direct-drive hydraulic valve for controlling a flow of fluid under pressure from a source to a driven device, comprising:

a valve body;

a valve member mounted for movement relative to said body along a predetermined path;

port means on said body and said member for establishing communication between the source and the driven device;

direct drive means for selectively moving said member relative to said body, including a mechanical driving connection with said member;

pressure balancing means for normally applying equal and oppositely directed forces to said member, including opposed hydraulic pressure chambers and means for normally equalizing the pressure in said chambers to produce said equal and oppositely directed forces;

and pressure differential means activated in response to the encountering of a resistance to movement of said member greater than a preselected force level for applying a hydraulic pressure differential to said pressure chambers to overcome the resistance to movement.

12. A direct-drive hydraulic valve as defined in claim 11 wherein said mechanical driving connection includes a check valve having a check valve member engaging and movable with the valve member and held closed by pressure from one of said pressure chambers determining said preselected force level.

13. A direct-drive hydraulic valve as defined in claim 12 wherein said check valve member is a ball, and said valve member has a bore forming a seat for said ball substantially smaller in diameter than the ball, said bore being connectible to relatively low pressure.

14. A direct-drive hydraulic valve as defined in claim 13 wherein said mechanical driving connection includes a driver disposed in said bore and moving said valve member by pushing on said ball.

15. A direct-drive hydraulic valve as defined in claim 11 wherein said direct drive means includes an incremental stepper motor having an eccentric output shaft that is turned in steps to produce an output for driving said mechanical driving connection.

16. A direct-drive hydraulic valve as defined in claim 11 wherein said mechanical driving connection includes a lever having a pivot between its ends and one end for engaging said mechanical driving connection and an opposite end for connection to a linear motor.

17. A direct-drive hydraulic valve as defined in claim 11 wherein said valve member is a valve spool having a longitudinal bore opening through one end of the spool, said mechanical driving connection includes an elongated pin loosely disposed in said longitudinal bore and having one end adjacent the open end of the bore, and said pressure differential means includes a check valve having a movable check valve member normally closing the open end of the bore and engaged by said pin to move said valve member.

18. A direct-drive hydraulic valve for controlling a flow of fluid under pressure from a source to a driven device, comprising:

a valve body defining a spool bore having a plurality of valve ports spaced apart longitudinally of the bore;

a valve spool slidably mounted in said spool bore having spool ports for communicating between said valve ports and having a longitudinal bore opening through one end of the spool;

a check valve having a movable check valve member normally closing said longitudinal bore at said one end of said spool;

a driver pin loosely and movably disposed in said longitudinal bore and engaging said movable check valve member;

a mechanical driver for pushing on said drive pin to exert a moving force on said valve spool through said check valve member;

means for urging said check valve member closed with a preselected closing force, and for permitting said check valve member to be opened by a moving force greater than said closing force;

and hydraulic means responsive to opening of said check valve and operable to apply a greater moving force to said valve spool.

* * * * *